US007631406B2

(12) United States Patent
Fechter

(10) Patent No.: US 7,631,406 B2
(45) Date of Patent: Dec. 15, 2009

(54) DEVICE FOR HYDRODYNAMIC INTERTWINING OF FIBERS IN A FIBER WEB

(75) Inventor: Thomas Fechter, Hanau (DE)

(73) Assignee: Fleissner GmbH, Egelsbach (DE)

( * ) Notice: Subject to any disclaimer, the term of this patent is extended or adjusted under 35 U.S.C. 154(b) by 87 days.

(21) Appl. No.: 11/571,203

(22) PCT Filed: May 27, 2005

(86) PCT No.: PCT/EP2005/005697

§ 371 (c)(1),
(2), (4) Date: Jan. 15, 2008

(87) PCT Pub. No.: WO2006/000282

PCT Pub. Date: Jan. 5, 2006

(65) Prior Publication Data

US 2008/0307619 A1 Dec. 18, 2008

(30) Foreign Application Priority Data

Jun. 23, 2004 (DE) ..... 10 2004 030 413

(51) Int. Cl.
*D04H 1/46* (2006.01)

(52) U.S. Cl. ..... 28/104; 28/105; 28/167

(58) Field of Classification Search ..... 28/104, 28/105, 167, 103, 106, 107, 111; 19/296, 19/161.1; 68/204, 205 R; 162/363, 364, 162/367, 115; 156/148
See application file for complete search history.

(56) References Cited

U.S. PATENT DOCUMENTS 4,483,745 A * 11/1984 Wicks et al. ..... 162/205
4,668,322 A * 5/1987 Christensen ..... 19/296
5,718,022 A 2/1998 Vuillaume ..... 28/105
5,761,778 A * 6/1998 Fleissner ..... 28/104
5,960,525 A * 10/1999 Fleissner ..... 28/104
6,055,710 A * 5/2000 Fleissner ..... 28/104
6,375,773 B1 * 4/2002 Andersen ..... 156/148
7,331,089 B2 * 2/2008 Christensen ..... 28/103
7,392,575 B2 7/2008 Noelle ..... 28/116
2003/0217448 A1 * 11/2003 Andersen ..... 28/104
2005/0115036 A1 * 6/2005 Noelle ..... 28/104
2006/0042057 A1 * 3/2006 Taniguchi et al. ..... 28/104

(Continued)

FOREIGN PATENT DOCUMENTS

EP 754 255 1/1997

(Continued)

*Primary Examiner*—Amy B Vanatta
(74) *Attorney, Agent, or Firm*—Andrew Wilford

(57) ABSTRACT

A device is known in which the bulky felt arriving on the top side of an endless belt for water felting is compacted between a felting drum and the belt and at the same time it is wetted by a first water curtain from a nozzle beam, whose water jets first pass through the endless belt and then the fiber web and finally the felting drum. Now, according to the invention, the unconsolidated felt is held against the bottom of an endless belt by means of induced suction and transported, and it is brought up tangentially to a needle felting drum, arranged beneath the endless belt. In this way, the handover of the fiber web from the endless belt to the needle felting drum is accomplished under the influence of gravity.

5 Claims, 1 Drawing Sheet

U.S. PATENT DOCUMENTS

| | | | | |
|---|---|---|---|---|
| 2006/0080816 | A1 * | 4/2006 | Noelle | 28/116 |
| 2007/0261220 | A1 * | 11/2007 | Schweizer et al. | 28/104 |

FOREIGN PATENT DOCUMENTS

| | | | |
|---|---|---|---|
| EP | 0 818 568 | | 1/1998 |
| EP | 0188568 | | 1/1998 |
| EP | 0 859 076 | | 8/1998 |
| EP | 0859076 | | 8/1998 |
| EP | 1 553 222 | | 7/2005 |
| EP | 1533222 | | 7/2005 |
| FR | 2 730 246 | | 8/1996 |
| FR | 2730246 | | 8/1996 |
| WO | WO-9623921 | | 8/1996 |
| WO | WO-02/055778 | | 7/2002 |
| WO | WO-02055778 | | 7/2002 |
| WO | WO-2004/033780 | | 4/2004 |
| WO | WO 2004/033781 | A2 * | 4/2004 |
| WO | WO-2004033780 | | 4/2004 |
| WO | WO-2004/046444 | | 6/2004 |
| WO | WO-2004046444 | | 6/2004 |

* cited by examiner

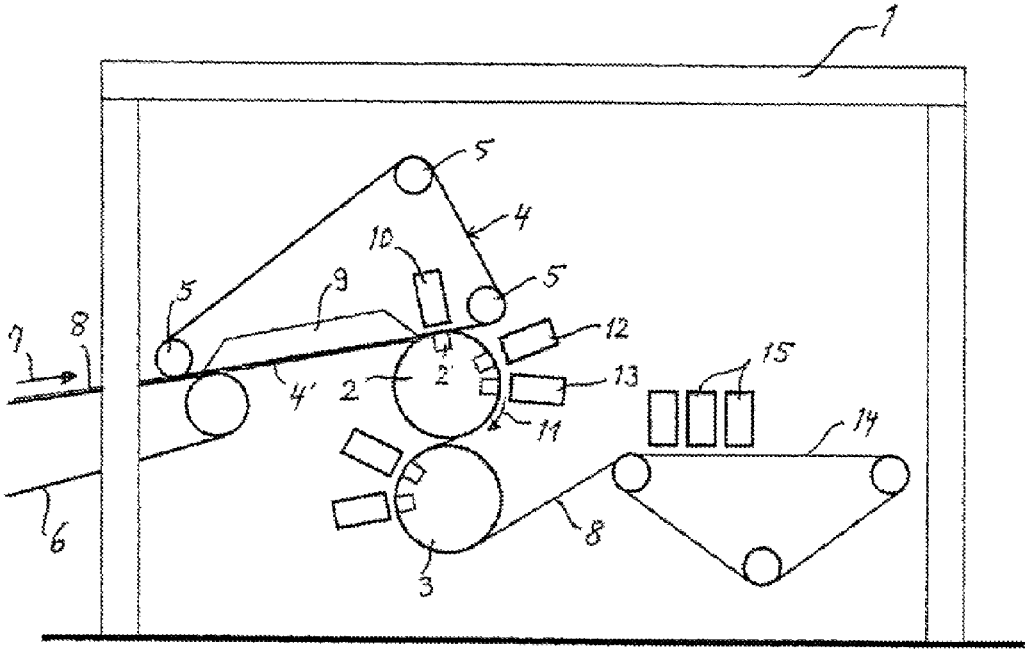
1
5
4
10
5
9
5
8
7
12
4'
2
2'
13
15
11
14
6
8
3

DEVICE FOR HYDRODYNAMIC INTERTWINING OF FIBERS IN A FIBER WEB

CROSS REFERENCE TO RELATED APPLICATIONS

This application is the US national phase of PCT application PCT/EP2005/005697, filed 27 May 2005, published 5 Jan. 2006 as WO2006/000282, and claiming the priority of German patent application 102004030413.0 itself filed 23 Jun. 2004, whose entire disclosures are herewith incorporated by reference.

FIELD OF THE INVENTION

The invention pertains to a device for hydrodynamic intertwining in order to compact the fibers of a web made from natural and/or synthetic fibers of any given kind, preferably free of bonding agent, consisting of:

a) a single conveyor belt transporting the fiber web and spanned and deflected over at least two rolls, b) a needle felting drum juxtaposed with the endless belt, preferably across the working width thereof, and having parallel to itself at least one nozzle beam, c) at least one nozzle beam whose water jets are directed against a back face of the endless belt and, through the endless belt against the fiber web and the needle felting drum, at least for wetting same.

A compacting device is described in EP-A-0 859 076 (U.S. Pat. No. 5,960,525). Its task is to compact the bulky felt arriving on an endless belt for the water felting process between the felting drum and two belts and at the same time it is wetted by a first water curtain from the nozzle beam, whose water jets pass through the endless belts and the fiber web and finally the felting drum. The same holds for the device per EP-A-0 818 568 (U.S. Pat. No. 5,761,778), in which two felting drums arranged one above the other are used for compaction on both sides of the fiber web.

The known device per EP-A-0 818 568 involves the problem of the slow compressing of the fiber web, consisting of loose fibers not consolidated together with each other and also the upstream wetting in the pressed condition. This also holds for lighter felt, but the danger exists that the still loose fibers of the web being compacted will be forced into the felting drum, get caught there, and cause problems when removing the fiber web after the felting process. A negative slack is produced in the fiber web, which is detrimental to the strength of the fiber felt. The problem is taken up by WO 2004/046444, which proposes making possible a better loosening of the fiber web after the felting process by arranging and orienting the nozzle beam so that the water jets of the beam hit the fiber web in its direction of transport only after the line or region of compression is passed. This step cleans away the fibers picked up by the endless belt immediately after or during the needle felting. However, a second endless belt is also passed around the needle felting drum here, increasing the resistance on the drum during the felting, yet transporting the fiber web onward in a tension-free condition. In many instances, such a second endless belt passed around the drum is not desirable, and then the transport of the fiber web is no longer assured.

OBJECT OF THE INVENTION

Based on the above mentioned device, the problem of the invention is to find a device with which even a light felt can be brought up easily for the first needle felting, be wetted there, and be grasped by the drum without fiber loss.

SUMMARY OF THE INVENTION

To attain the above-given object, according to the invention:

a) the endless belt is guided tangentially to the needle felting drum above the needle felting drum, b) the fiber web is engaged only on its lower outer face by the endless belt, and c) after the first needling, the felt is transferred by means of at least one nozzle beam downward to the needle felting drum.

This device uses the principle known from EP-A-754 255 (U.S. Pat. No. 5,718,022): only the fiber web is wound around the felting drum and not an additional endless belt, but the endless belt bring up the felt supports the felt on its upper side, and thus it lies by virtue of gravity on the endless belt and the drum must pull the fiber web off from the endless belt, which still causes negative slack. With the device of the invention the impulse of the nozzle beam to loosen the felt from the endless belt bringing up the felt on its bottom side is supported by the constantly acting force of gravity. This results in a slack-free detachment of the felt from the endless belt. Preferably, an induced draft is created on the bottom side of the endless belt carrying the fiber web by placing a suction box above the lower run of the endless belt and putting it under an induced draft.

BRIEF DESCRIPTION OF THE DRAWING

One device of the invented kind is shown in the drawing as an example in a schematic side view with two needle felting drums arranged one above the other and guiding the fiber web in meandering fashion, an endless belt tangentially engaging the fiber web to convey it.

SPECIFIC DESCRIPTION

In a frame 1 there is shown a compacting water felting mechanism with two needle felting drums 2, 3. This unit is normally the first unit of a larger water felting layout for an unconsolidated fiber web 8, and therefore other felting drums (not shown) can also be hooked up to it, also with the web 8 running in meandering manner around them and being further processed on both sides.

Essentially, this unit consists of an endless belt 4, which is passed around several rolls 5, able to rotate in a support frame (not shown) and held taut, while its lower reach 4' extends tangentially to the top side of the first felting drum 2. The fiber web 8 arrives from the conveyor belt 6, which can be, for example, the exit belt of a carding machine and carries the fiber web 8 on its top side. The initially bulky fiber web 8 travels on this endless belt 6 in the direction of the arrow 7, going to the needle felting process. At the end of the conveyor belt 6, above the conveyor belt 6, is located the lower reach 4' of the endless belt 4, which is parallel with the conveyor belt 6 and also moves in the direction of the arrow 7. The unconsolidated fiber web 8 is held against the lower face of the lower reach 4' by means of a suction box 9. This acts along the length of the lower reach 4' of the endless belt 4 as far as the needle felting drum 2. As shown by the drawing, the lower reach 4' lies above the idler rolls of the endless belt 6 and the needle felting drum 2. The upstream idler roll of the endless belt 6 lies roughly in the region of the downstream idler roll 5 of the endless belt 4 and the downstream idler roll 5 lies somewhat downstream of the upper needle felting drum 2. As mentioned, the first suction box 9 holds the fiber web 8 against the lower end of the lower reach 4', which is sealed off against the belt 4. At the downstream end of the suction box 9, the fiber web 8 is pressed between the endless belt 4 and the drum 2 and at the same time it is wetted by means of the nozzle beam 10 extending the full width of the fiber web 8 and needled through the belt 4. The liquid applied is at least partly sucked away beneath the drum surface by means of a second suction box 2', which is provided inside the needle felting drum 2.

Now, it is important that the fiber web 8, lying alone on the drum 2 without a second endless belt, is led down in the direction of the arrow 11. The water jets from the nozzle beam 10 are acting from top to bottom. Movement of the fiber web 8 to the drum 2 is also from top to bottom, i.e., in the direction of gravity. Thus, this supports the load-free transfer of the still unconsolidated fiber web or felt 8 to the first needle felting drum 2, which is then coordinated with two nozzle beams 12, 13 fully capable of needle felting. The same holds for the second needle felting drum 3.

The now consolidated felt 8 can then be dried or further processed, e.g., perforated or embossed, to which end a belt 14 with additional nozzle beam 15 can be provided.

The invention claimed is:

1. A device for hydrodynamically consolidating a fiber web, the device comprising:

conveyor means for supplying the web to an intake location;

a rotatable needling upper drum offset horizontally from the intake location;

an endless conveyor belt having a reach extending generally horizontally from the intake location to the needling upper drum and bearing downward on the upper drum;

a vacuum box above the reach for suctionally retaining the web against the lower face of the reach between the location and the upper drum, the belt being advanced so as to convey the web suctionally adhered to its lower face from the intake location to the upper drum, the upper drum being rotated so as to advance the web downward after leaving contact with the reach;

a first needle beam above the reach and above the upper drum for projecting water jets through the reach and through the web to entangle fibers of the web; and at least one second needle beam juxtaposed with the upper drum downstream of the first needle beam for projecting water jets through the web and against the upper drum.

2. The consolidating device defined in claim 1 wherein the beams extend parallel to an axis of rotation of the upper drum.

3. The consolidating device defined in claim 1, further comprising respective suction boxes inside the upper drum aligned with the beams for aspirating water from the respective jets after passing through the web and the upper drum.

4. The consolidating device defined in claim 1 wherein the conveyor means includes another belt having an upper reach extending generally horizontally to the location, the other belt being advanced to move the web to the location, the web being on an upper face of the upper reach of the other belt.

5. The consolidating device defined in claim 1, further comprising a lower drum underneath the upper drum and rotating oppositely to the upper drum, the web passing downward around the lower drum in a meander; and at least one further needle beam juxtaposed with the lower drum downstream of the first needle beam for projecting water jets through the web and against the lower drum.

* * * * *